US006634900B2

(12) United States Patent
Hu et al.

(10) Patent No.: US 6,634,900 B2
(45) Date of Patent: Oct. 21, 2003

(54) ELECTRICAL CONNECTOR HAVING INSULATING INSERT FOR ASSEMBLING CARD EJECTOR

(75) Inventors: Jinkui Hu, Kunsan (CN); Guohua Zhang, Kunsan (CN); ZiQiang Zhu, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/253,228

(22) Filed: Sep. 23, 2002

(65) Prior Publication Data

US 2003/0109162 A1 Jun. 12, 2003

(30) Foreign Application Priority Data

Dec. 7, 2001 (TW) ..... 90221377 U

(51) Int. Cl.[7] ..... H01R 13/62
(52) U.S. Cl. ..... 439/328; 439/159
(58) Field of Search ..... 439/152–155, 439/157, 159, 160, 325, 326, 328

(56) References Cited

U.S. PATENT DOCUMENTS 6,074,231 A * 6/2000 Ju ..... 439/327
6,083,026 A * 7/2000 Trout et al. ..... 439/328
6,332,792 B1 * 12/2001 Lin et al. ..... 439/160
6,478,592 B1 * 11/2002 Hu et al. ..... 439/159
6,503,093 B1 * 1/2003 Sakata et al. ..... 439/328

* cited by examiner

*Primary Examiner*—Hien Vu
(74) *Attorney, Agent, or Firm*—Wei Te Chung

(57) ABSTRACT

An electrical connector (4) comprises an insulating housing (1) defining two rows of contact passageways (6) for receiving two rows of terminals therein, and a separate insulating insert (2) for being assembled to an arm of the housing for carrying a card ejector. The arm defines a dove-tailed retaining slot (11) in an outer surface (121) thereof, and a pair of apertures (131) in communication with the retaining slot. The insulating insert includes a main body (22) and a retaining portion (21) retained within the retaining slot of the arm of the housing. The retaining portion further includes a pair of teeth (2131) engagingly received in the apertures of the arm of the housing. The main body of the insulating insert defines a slot adapted for receiving the card ejector.

2 Claims, 4 Drawing Sheets

ELECTRICAL CONNECTOR HAVING INSULATING INSERT FOR ASSEMBLING CARD EJECTOR

BACKGROUND OF THE INVENTION

1. Field of the Invention

The present invention relates to an electrical connector, and particularly to an electrical connector having a separate insulating insert for facilitating assembling of a card ejector to the connector.

2. Description of Related Art

Recently, electronic card connectors are more and more widely used to connect various electronic cards to mainframes thereby to provide various functions to the mainframes. To facilitate the replacement of the cards to the connectors, the connectors are provides with card ejectors to eject inserted electronic cards from the connectors. The ejectors may be made of metallic/insulating materials and are assembled to metallic shells/insulating housings of the connectors directly or via inserts assembled to the shells/housings.

FIG. 7 shows a prior art electrical connector having a card ejector 51 assembled to a metal shell 52 of the connector. The shell 52 defines a plurality of retaining recesses 521 engaged with corresponding retaining clips 511 of the ejector 51 to secure the ejector 51 to the shell 52. However, such a complicated structure of the retaining recesses 521 and the retaining clips 511 obviously increases the manufacturing and assembling costs of the connector.

SUMMARY OF THE INVENTION

Accordingly, an object of the present invention is to provide an electrical connector having a separate insulating insert for facilitating and simplifying assembling of a card ejector to the electrical connector wherein the insert has a simple structure.

In order to achieve the objects set forth, an electrical connector of the present invention comprises an insulating housing defining two rows of contact passageways for receiving two rows of terminals. A separate insulating insert is assembled to an arm of the housing for carrying a card ejector. The arm of the housing defines a dove-tailed retaining slot and a pair of apertures in communication with the retaining slot. The insulating insert includes a main body and a retaining portion fittingly retained in the retaining slot of the arm of the housing. The retaining portion further includes a pair of teeth engagingly received in the apertures of the housing. The main body of the insulating insert defines a slot in an outer surface thereof for receiving a pushing bar (not shown) of the card ejector (not shown).

Other objects, advantages and novel features of the invention will become more apparent from the following detailed description of the preferred embodiment when taken in conjunction with the accompanying drawings.

DETAILED DESCRIPTION OF THE INVENTION

Figure 1:
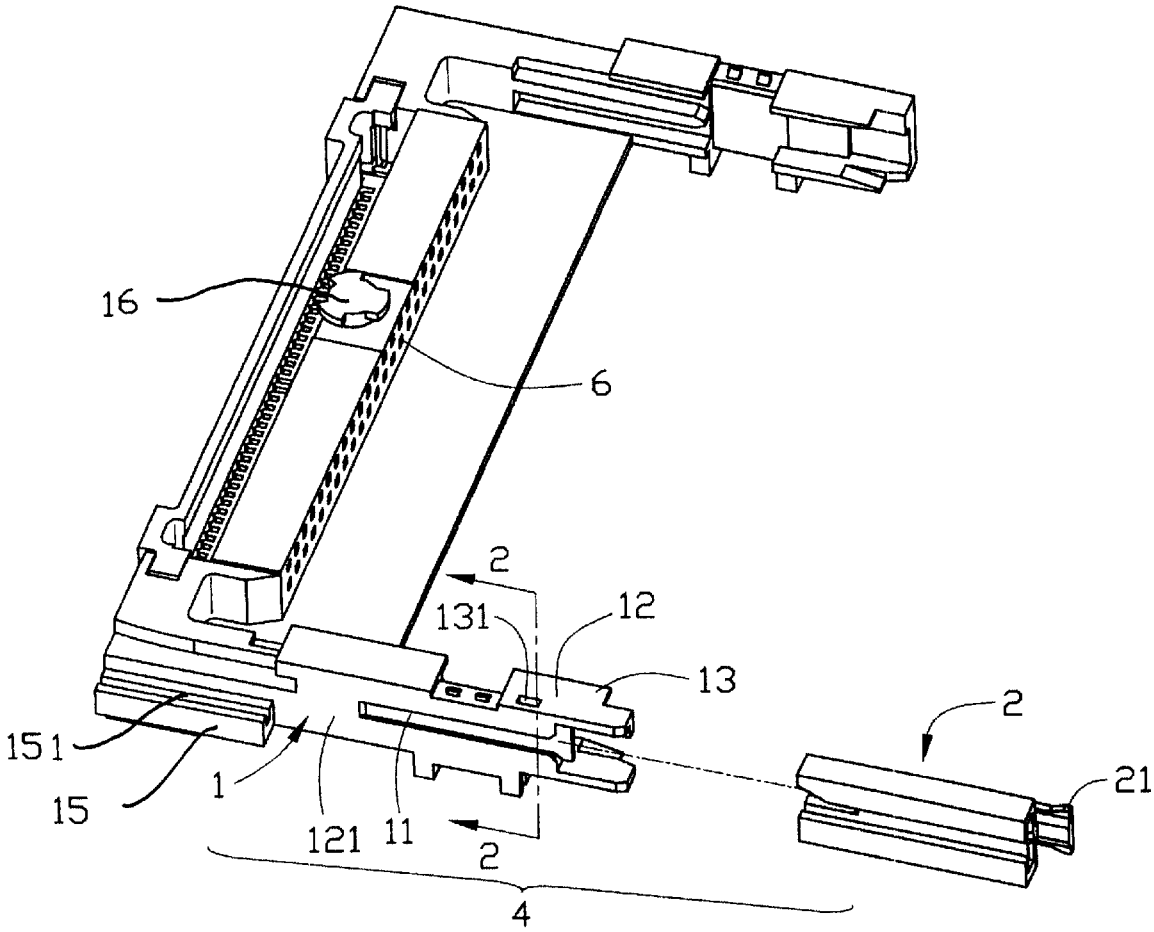
FIG. 1 is a perspective view of an electrical connector of the present invention wherein terminals are not shown.

Reference will now be made to the drawing figures to describe the present invention in detail.

Figure 2:
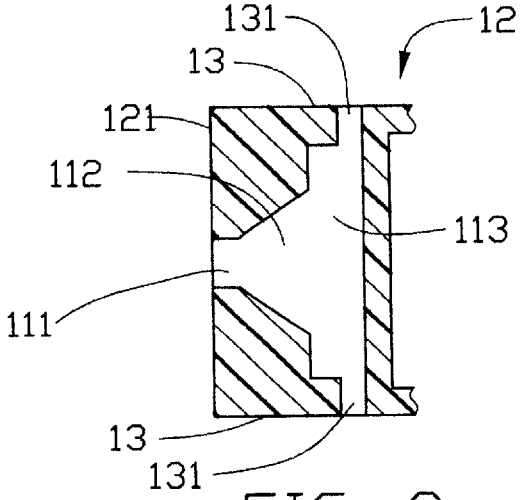
FIG. 2 is a partially cross-sectional view taken along line 2—2 of FIG. 1.

Referring to FIGS. 1 and 2, an electrical card connector 4 includes an insulating housing 1 defining two rows of contact passageways 6 for receiving two rows of terminals (not shown) therein and an insulating insert 2 assembled to the housing 1. The insulating insert 2 is used for receiving a card ejector (not shown) for ejecting an electrical card (not shown) inserted into the connector 4.

An arm 12 extends from a lateral end of the housing 1 and defines a dove-tailed retaining slot 11 in an outer surface 121 thereof. The insert 2 includes a retaining portion 21 to be retained in the retaining slot 11 of the arm 12 of the housing 1. The retaining slot 11 is composed of a small rectangular passage 111 exposed to the outer surface 121, a trapezoidal section 112 in inner of the small passage 111, and a large rectangular passage 113 in inner of the trapezoidal section 112. The arm 12 of the housing 1 further defines top and bottom surfaces 13. A pair of apertures 131 is defined in the top and bottom surfaces 13, respectively, and in communication with the larger rectangular passage 113.

Figure 3:
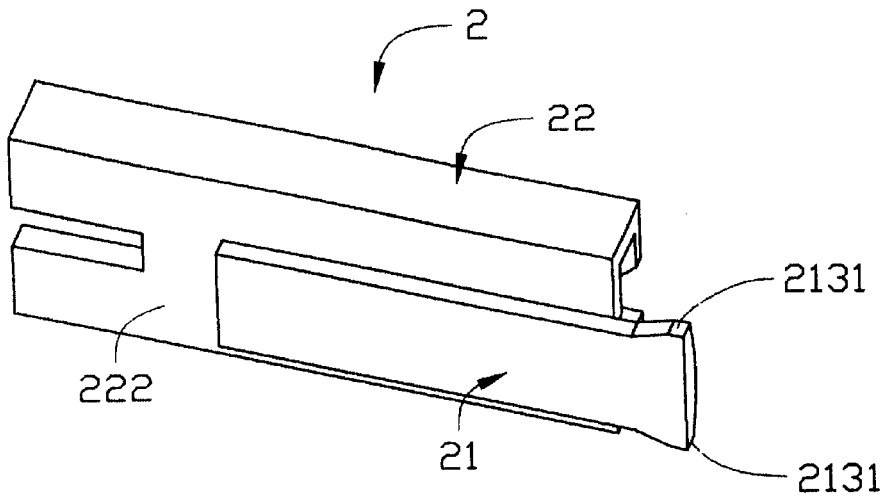
FIG. 3 is an enlarged view of an insulating insert of FIG. 1 from another aspect.
Figure 4:
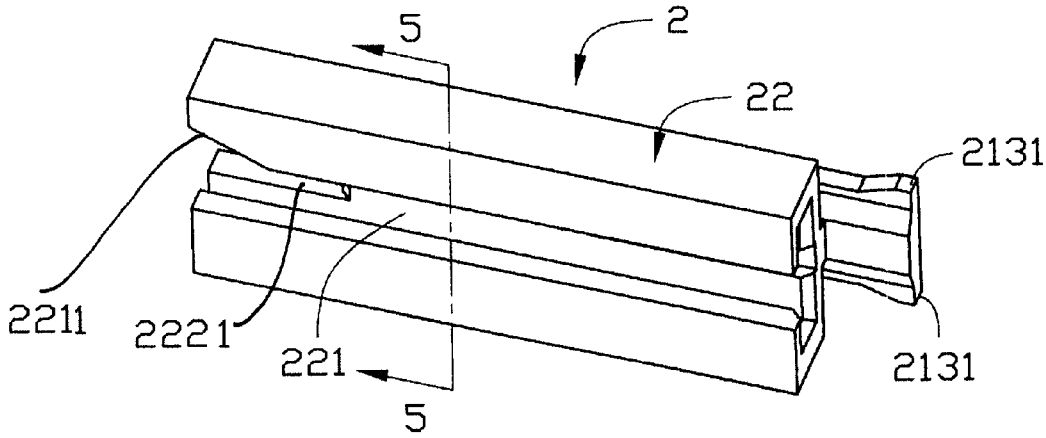
FIG. 4 is an enlarged view of the insulating insert of FIG. 1.
Figure 5:
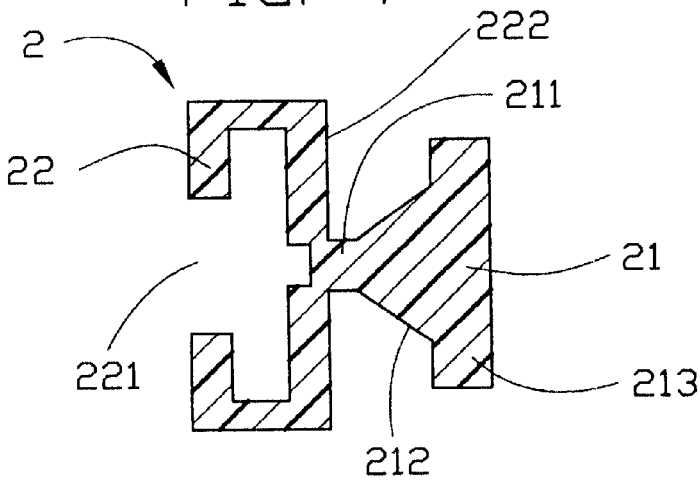
FIG. 5 is a cross-sectional view taken along line 5—5 of FIG. 4.

Referring to FIGS. 3, 4 and 5, the insert 2 includes the retaining portion 21 and a main body 22 having a contact surface 222 for engaging with the outer surface 121 of the arm 12 of the housing 1. The main body 22 defines a slot 221 in a surface opposite to the contact surface 222 for receiving a pushing bar (not shown) of the card ejector (not shown).

Referring to FIGS. 2 and 5, the retaining portion 21 of the insert 2 includes a connect portion 211 connected with the main body 22, a trapezoidal portion 212 and a rectangular portion 213 connecting with the trapezoidal portion 212. The rectangular portion 213 includes a pair of teeth 2131 protruding respectively upwards and downwards from top and bottom edges of a rear end of the retaining portion 21.

Figure 6:
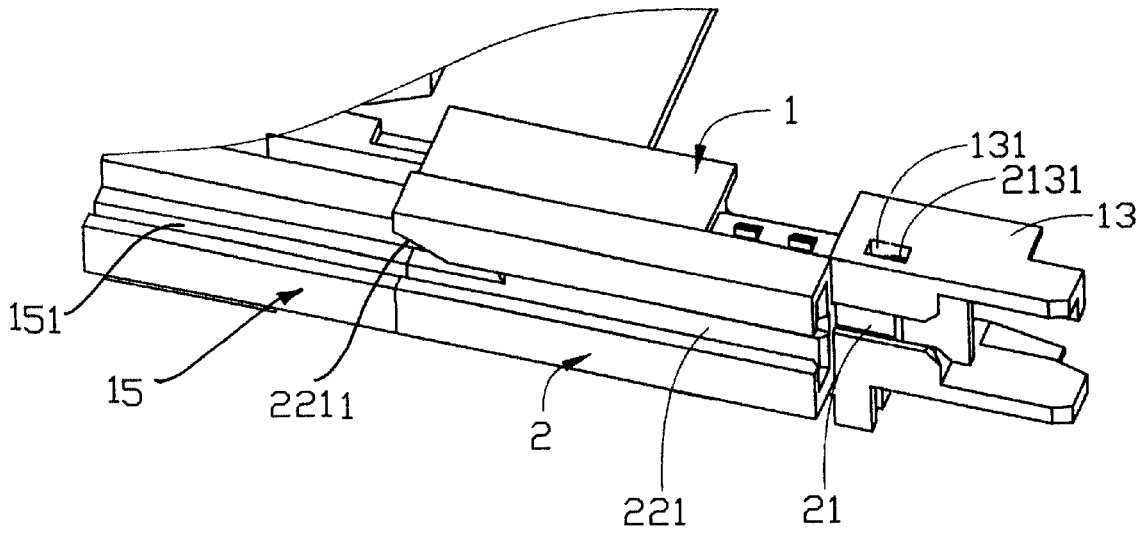
FIG. 6 is a perspective view of a portion of the electrical connector, showing a connection between the insert and the electrical connector.
Figure 7:
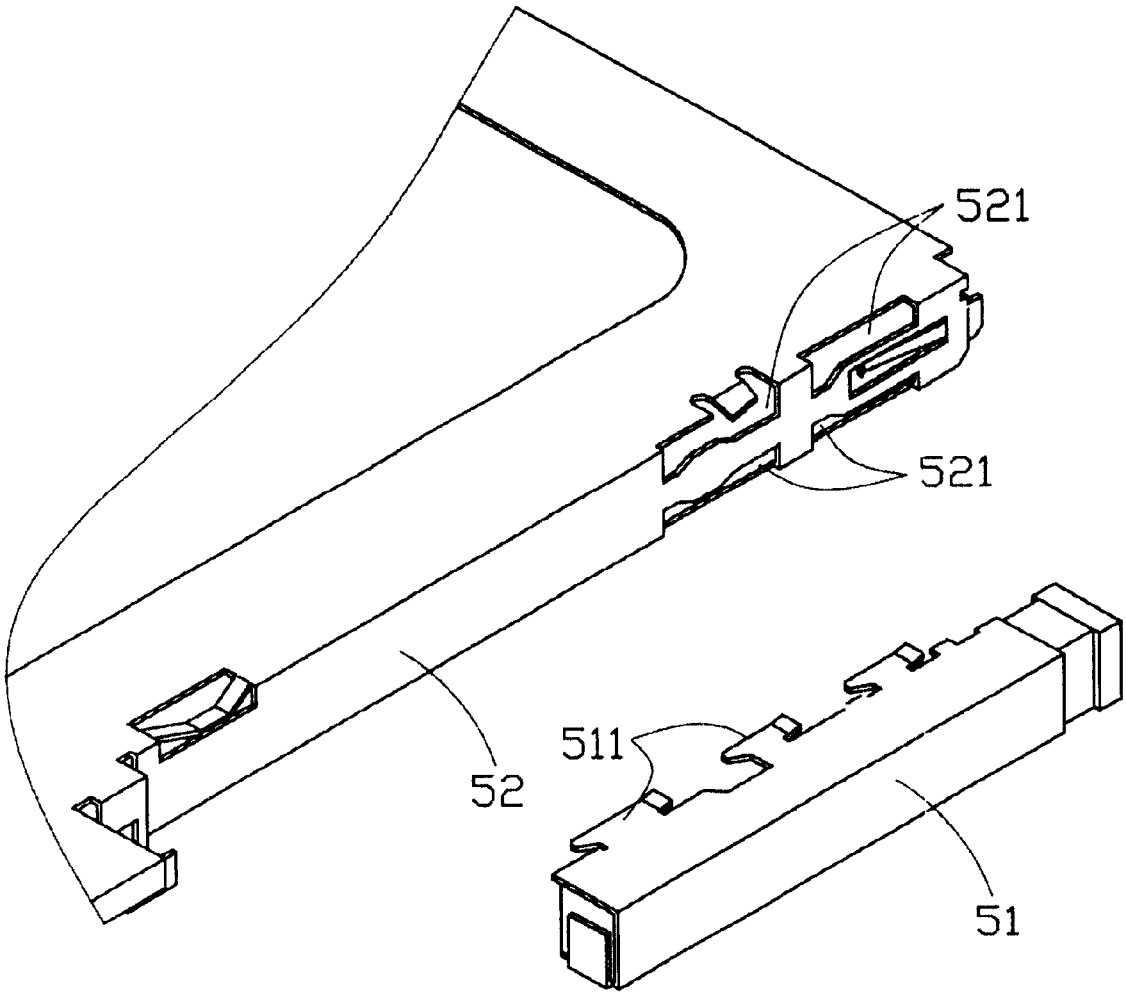
FIG. 7 (PRIOR ART)
FIG. 7 is a perspective view of a portion of a prior art electrical card connector.

Referring to FIG. 6, in assembly, the retaining portion 21 is fittingly inserted into the retaining slot 11 of the arm 12 of the housing 1 until the teeth 2131 are snapped into the apertures 131 of the arm 12 of the housing 1. The contact surface 222 abuts against the outer surface 121 of the arm 12. The connect portion 211 fittingly engages in the small rectangular passage 111, the trapezoidal portion 212 engages in the trapezoidal section 112, and the rectangular portion 213 engages in the large rectangular passage 113, thereby the insert 2 is firmly secured to the housing 1.

It is noted that refereeing to FIGS. 1 and 6 in the embodiment the housing 1 includes an end pier 15 with a channel 151 aligned and connected with the slot 221 when the insert 2 is assembled to the housing 1 for extension of the pushing bar (not shown) of the card ejector (not shown). It is also seen that referring to FIG. 4 the front end of main body 22 of the insert 2 provides a slanted guiding surface 2211 incorporating the indent 2221 of the main body 22 for guidably receiving the joint of the front end of the push bar (not shown) and the distal end of the lever (not shown) which is pivotally mounted on the pivot 16 (FIG. 1) for ejecting the inserted card (not shown).

A first advantage of the present invention is that the insulating insert 2 has a simple structure thereby decreasing the manufacturing costs.

A second advantage of the present invention is that the insulating insert 2 can be readily assembled to the housing 1 thereby decreasing the assembling costs.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical card connector comprising:

an insulating housing defining a plurality of contact passageways for receiving terminals therein, an arm extending from a lateral end of the housing, the arm defining a retaining slot and a pair of apertures in communication with the retaining slot; and an insulating insert including a main body adapted for receiving a card ejector for ejecting an electronic card inserted into the connector, a retaining portion retained within the retaining slot of the housing, and a pair of teeth integrally formed at the retaining portion and engagingly received in the apertures of the arm of the housing; wherein the retaining slot includes an outer small rectangular passage, the retaining portion of the insert has a connect portion connecting with the main body thereof, the connect portion being fittingly engaged in the small rectangular passage of the retaining slot; wherein the retaining slot includes a trapezoidal section in inner of the small rectangular passage, the retaining portion of the insert has a trapezoidal portion fittingly engaged in the trapezoidal section of the retaining slot; wherein the retaining slot includes a large rectangular passage in inner of the trapezoidal section, the retaining portion of the insert has a rectangular portion fittingly engaged in the large rectangular passage; wherein the apertures are defined through upper and lower surfaces of the arm of the housing, the teeth being respectively protruded upwards and downwards from top and bottom faces of an end of the rectangular portion of the retaining portion of the insert.

2. The electrical card connector as claimed in claim 1, wherein the main body of the insert is located outside the arm of the housing.

* * * * *